United States Patent [19]

Matsui et al.

[11] Patent Number: 4,544,107

[45] Date of Patent: Oct. 1, 1985

[54] COP DELIVERY SYSTEM

[75] Inventors: Isamu Matsui; Yoshio Yamamoto; Kazuo Nakanishi; Masaharu Kiriake; Akira Shimamoto, all of Kyoto, Japan

[73] Assignee: Murata Kikai Kabushiki Kaisha, Japan

[21] Appl. No.: 421,810

[22] Filed: Sep. 23, 1982

[30] Foreign Application Priority Data

Sep. 25, 1981 [JP] Japan ..... 56-152361

[51] Int. Cl.[4] ..... B65H 54/20; B65H 67/06

[52] U.S. Cl. ..... 242/35.5 A

[58] Field of Search ..... 242/35.5 A, 35.5 R, 242/35.6 R, 35.6 E, 18 R, 18 EW

[56] References Cited

U.S. PATENT DOCUMENTS

| | | | |
|---|---|---|---|
| 2,208,930 | 7/1940 | Kahlisch | 242/35.6 R |
| 2,306,871 | 12/1942 | Esser et al. | 242/35.6 R |
| 3,154,904 | 11/1964 | Furst | 242/35.5 R X |
| 3,224,694 | 12/1965 | Isao Oishi | 242/35.5 R |
| 3,358,940 | 12/1967 | Beckwith, Jr. et al. | 242/35.5 R |
| 3,474,975 | 10/1969 | Brouwer et al. | 242/35.5 R |
| 3,506,209 | 4/1970 | Matsui et al. | 242/35.5 R |
| 3,850,377 | 11/1974 | Pitts et al. | 242/35.5 A |
| 3,933,320 | 1/1976 | Tsurumi et al. | 242/35.5 R |
| 3,966,141 | 6/1976 | Nishiyama et al. | 242/35.5 A |
| 4,212,433 | 7/1980 | Matsui et al. | 242/35.5 A |

FOREIGN PATENT DOCUMENTS

| | | | |
|---|---|---|---|
| 2216806 | 11/1972 | Fed. Rep. of Germany | 242/35.5 A |
| 2815105 | 10/1978 | Fed. Rep. of Germany | 242/35.5 A |
| 385573 | 3/1931 | United Kingdom | 242/35.5 A |

*Primary Examiner*—Stanley N. Gilreath
*Attorney, Agent, or Firm*—Spensley Horn Jubas & Lubitz

[57] ABSTRACT

A spinning frame is connected to the winder through a delivery passage comprising conveyor belts, rotary disc and the like to form a closed loop. Cops are inserted independently on trays arranged on the delivery passage and are circulated along said closed loop in the state where they are vertically inserted. When the residual yarn-retaining bobbin is detected, the bobbin is recirculated after required processes such as a pick finding operation.

6 Claims, 10 Drawing Figures

COP DELIVERY SYSTEM

BACKGROUND OF THE INVENTION

The present invention relates to a cop delivery system for conveying and supplying cops, coming from the spinning step, to a winder of the subsequent step.

Ordinarily, cops coming from the spinning step are once stored in a magazine box of a winder, and one cop is taken out from the magazine upon demand of a winding unit and supplied to said winding unit. Conventional winders are roughly divided into two types. In a winder of one type, a plurality of units are arranged on a circular or oval course and circulated along this course, and in a winder of the other type, a plurality of units are arranged along a line stationarily. In the winder of the circulation type, many cops are stored in a magazine located at a special position, and this circulation operation is temporarily stopped when a cop-requiring unit arrives at the position of the magazine and one cop is supplied to this unit from the magazine.

In a winder of the stationary unit type, each of many winding units arranged stationarily comprises a magazine unit for storing a plurality of cops therein, and when a certain unit requires a cop, one cop is taken out from the magazine of said unit and is supplied to said unit.

In each of the winders of the above two types, an operation of supplying cops to the magazine is necesaary, and whether this operation is performed by an operator or is automatically performed, it is indispensable that cops coming from the spinning step should be delivered to the vicinity of the magazine.

Various sevices have been proposed as means for conveying cops doffed from a spinning frame to a winder, and as the delivery method, there have been adopted (a) a method in which a number of cops are stored in a cop box and they are delivered by an operator or by delivery means such as a conveyor or crane, (b) a method in which automatic cop supply devices, which are attached to a spinning frame and a winder, are connected to each other through a conveyor and cops are conveyed while they are laid on the conveyor, and (c) a method in which pegs are secured to the above conveyor and cops are conveyed while they are vertically inserted on the pegs.

All of these methods, however, are defective in that the conveying operation is laborious and various installations are necessary. Furthermore, when cops are conveyed while they are packed in a box, during the conveying operation, fluffs are formed on the surfaces of cops or wound yarn layers are broken, and yarn ends are entangled to render the pick finding operation difficult.

When cops are conveyed in the state where they are inserted on pegs arranged on a conveyor, separation of the cops from the pegs is necessary for charging them into the automatic cop supply device, and if it is intended to perform this operation automatically, it is necessary to dispose a machine hand for separating cops from the pegs. Moreover, in this case, there is a risk of formation of fluffs, breakage of wound yarn layers or damage of yarns because of yarn layers on the cops are contacted with one another.

SUMMARY OF THE INVENTION

The present invention relates to a cop delivery system for conveying and supplying cops, coming from the spinning step, to a winder of the subsequent step.

The present invention is to eliminate the foregoing defects and disadvantages of the conventional techniques. More specifically, the present invention provides a delivery system quite different from the conventional delivery systems, and the delivery system of the present invention connects a spinning frame directly to a winder and is capable of supplying cops to winding units very simply without causing yarn layers on the cops to fall in contact with other members. This delivery system of the present invention can be applied to not only a winder of the unit circulation type but also a winder of the stationary unit type.

According to the present invention, the spinning frame is connected to the winder through a delivery passage, for example, a conveyor belt, to form a closed loop, and cops are inserted independently on trays arranged on the conveyor belt and the cops are circulated along said closed loops in the state where they are vertically inserted and do not interfere with one another. In the midway of this circulation, when the cops arrive at the positions of respective winding units, the ordinary winding operation is carried out at each winding unit.

DETAILED DESCRIPTION OF THE INVENTION

The present invention will now be described in detail with reference to an embodiment, illustrated in the accompanying drawings, in which system of the present invention is applied to a winder of the stationary unit type.

Figure 1:
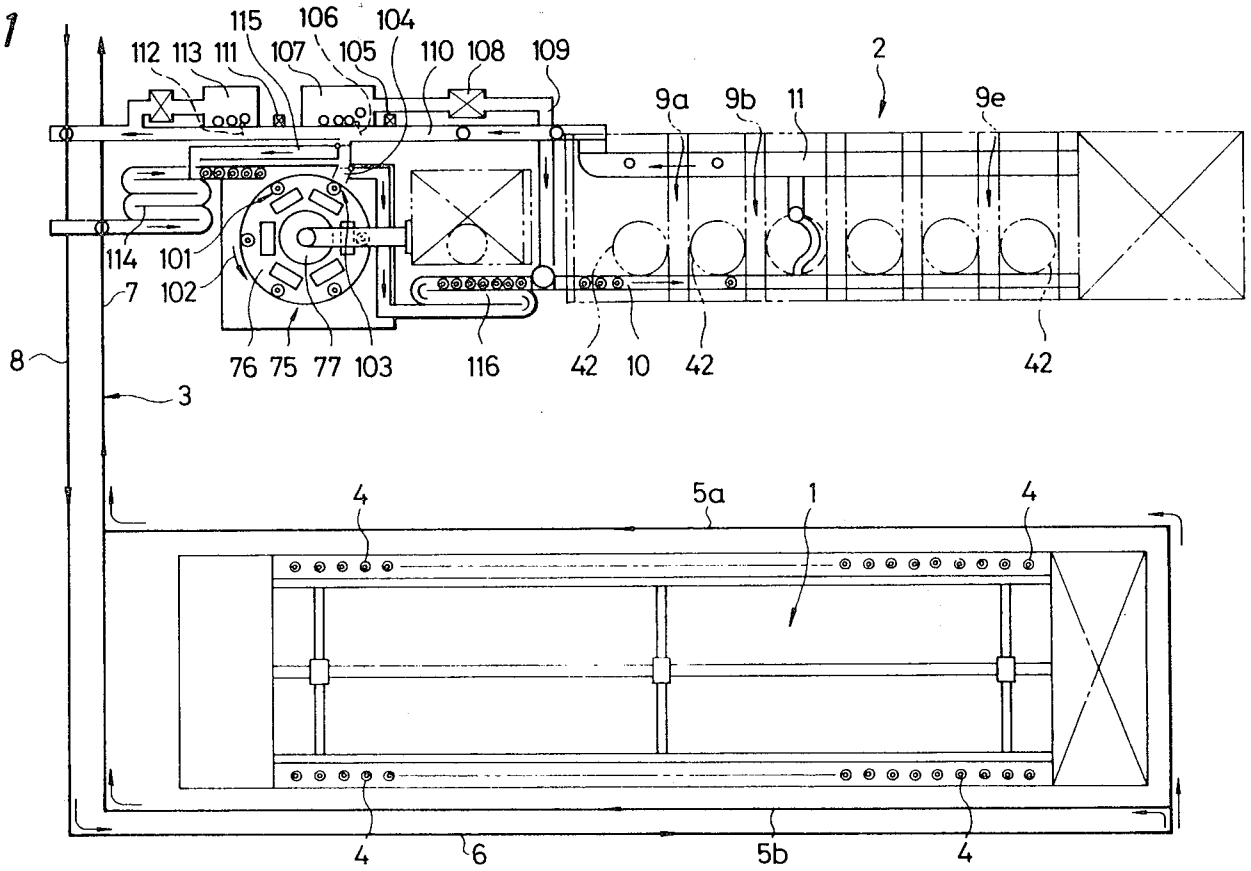
FIG. 1 is a diagram illustrating one embodiment of the layout of the system of the present invention.

FIG. 1 shows an example of the layout of a closed loop constructed by connecting a spinning frame 1 to a winder 2 through a conveyor 3. For example, a ring spinning frame is used as the spinning frame 1, and many units are arranged back to back. A spun yarn is wound on a bobbin 4. Cop delivery conveyors 5*a* and 5*b* and an empty bobbin supply conveyor 6 are arranged so that they turn along the spinning frame 1 as indicated by arrows. For example, conveyors of the flat belt type are used as these conveyors 5*a*, 5*b* and 6 and conveyors described hereinafter.

The changing method of cops in the above mentioned spinning frame, that is, the method for changing the empty bobbin on the tray to a new cop mounted on the spindle of the spinning frame, is disclosed in the specification of Japanese Public Disclosure No. 50631/79. The trays carrying an empty bobbin thereon and delivered on the conveyor are stopped on the conveyors 5*a* and 5*b*, which are arranged under the spindles of the spinning frame to be extending along the row of the spindles, at the predetermined position at the same intervals of the spindles, and then the changing operation of the bobbin to a full cop is accomplished simultaneously with respect to plural spindles by the cop changing apparatus as shown in the specification mentioned above.

Conveyors 7 and 8 are arranged to connect the spinning frame 1 to the winder 2, and the conveyor 7 delivers full cops coming from the spinning step and the conveyor 8 delivers empty bobbins discharged from the winder 2 to the spinning frame 1.

A cop supply conveyor 10 is arranged on one side of the winder 2 to supply full cops, delivered from the spinning frame 1, to respective winding units 9. On the other side of the winder 2, an empty bobbin delivery conveyor 11 is arranged to discharge and convey empty bobbin where the winding operation has been completed at the winding units. These conveyors 10 and 11 are connected to the conveyors 7 and 8, respectively.

Accordingly, a closed loop is constructed between the spinning frame 1 and the winder 2 by the cop supply conveyors 5*a*, 7 and 10 and the empty bobbin delivery conveyors 6, 8 and 11, and the cops and empty bobbins are conveyed along this loops.

Figure 2:
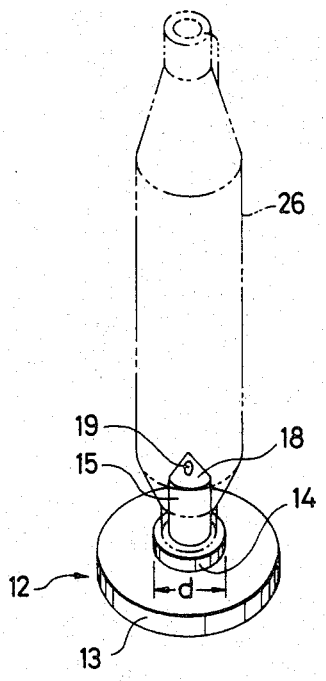
FIG. 2 is perspective view showing an example of the tray to be applied to the system of the present invention.

The cops and empty bobbins conveyed by the above-mentioned conveyors are delivered by carrier members (hereinafter referred to as "trays") shown in FIGS. 2 and 3.

This tray 12 is an integrally molded or secured member comprising a disc-like base 13 to be placed on the conveyor, a disc-like stand 14 formed on the top face of the base 13 and a peg 15 vertically erected from the stand 14. The inner bottom face of the tray 12 has an opening 16 which is communicated with the hollow interior 17 of the peg 15, and an air jet hole 19 is formed on the inclined face of the conical top 18 of the peg 15. The diameter of the peg 15 is substantially equal to the inner diameter d2 of a bobbin 20, and the length of the peg 15 is such that when a full cop is inserted thereon, the full cop can be vertically retained. Of course, an optimum length is set according to the size of the cop.

The diameter D1 of the disc-like base 13 is at least larger than the maximum diameter of the full cop to be inserted, that is, the outer diameter d1 of the yarn layer, so that while the cops are delivered by the trays, the cops are prevented from falling in contact with one another. Accordingly, the cops can be conveyed in the state where they are maintained in the vertical posture independently from one another.

Figure 3:
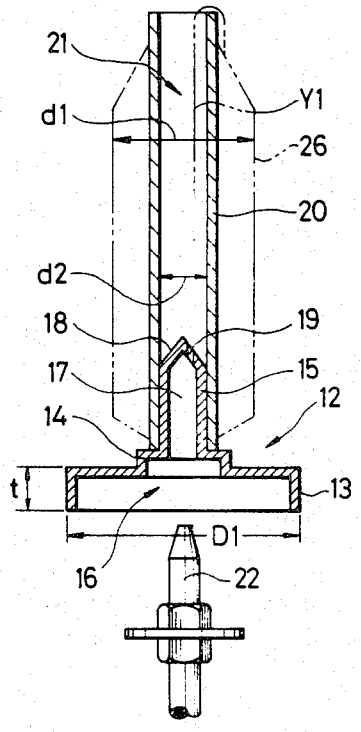
FIG. 3 is a sectional view of the tray.

For the yarn knotting operation, the yarn end Y1 taken out from the cop is hung down and inserted in a central hole 21 of the bobbin 20, as shown in FIG. 3, and in this state, the bobbin 20 is supplied to the winding unit. At the knotting operation, air jetted from a nozzle 22 located at a predetermined position on the winding unit is jetted into the central hole 21 of the bobbin from the interior of the tray 12 through the hole 16 of the peg 15, whereby the hung yarn end Y1 is blown up from the hole 21 of the bobbin 20 and sucked and held by a suction arm.

An embodiment of the device for supplying cops, delivered by the above-mentioned trays, to the winding units will now be described.

Figure 4:
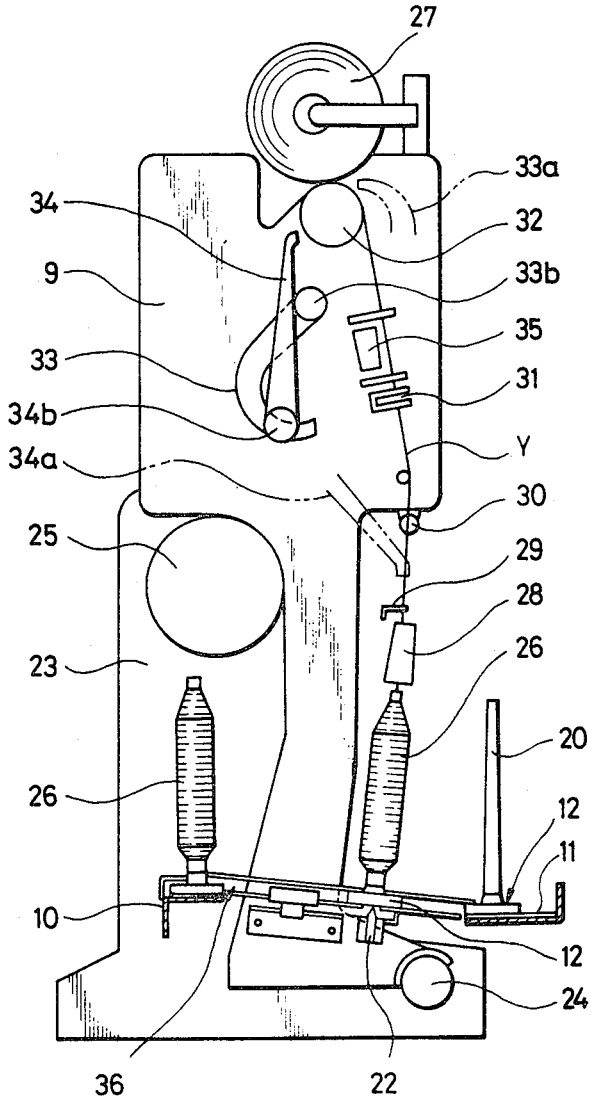
FIG. 4 is a schematic side view illustrating an example of the winding unit to be applied to the system of the present invention.
Figure 5:
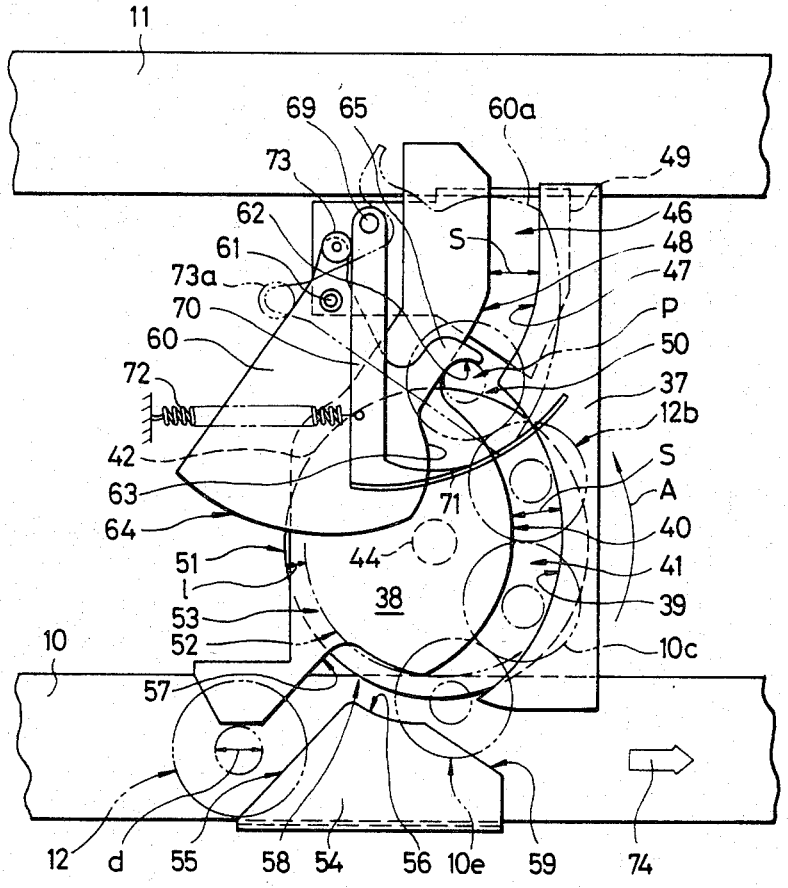
FIG. 5 is a plan view showing the tray-receiving portion of the winding unit.

A winding unit 9 that is applied to the system of the present invention is shown in FIGS. 4 and 5. Referring to FIG. 4, a supporting shaft 24 and a suction pipe 25 are laid out between side frames 23, and the winding unit 9 is turnably supported on the supporting shaft 24. While the automatic winder is being operated, the winding unit 9 is placed also on the suction pipe 25 and is appropriately secured. Incidentally, the suction pipe 25 is connected to a blower (not shown) so that a sucking current always acts on the suction pipe 25.

In the above-mentioned winding unit, winding of a yarn on a package 27 from a cop 26 is carried out in the following manner. The yarn taken out from the cop 26 on the tray 12 is passed through a balloon breaker 28 and a yarn guide 29 and an appropriate tension is given to the yarn by a tenser 30. Then, the yarn is passed through a slub catcher 31 and is wound on the package 27 rotated by a winding drum 32.

When the slub catcher 31 detects a slub in the yarn, a cutter arranged in the vicinity of the slub catcher 31 is actuated to cut the running yarn Y and stop the winding operation. Simultaneously, a first suction arm 33 is actuated to guide the yarn on the side of the package 27 to a knotter 35 arranged at a position apart from the normal yarn passage Y and a second suction arm 34 is actuated to guide the yarn on the side of the cop 26 to the knotter 35. After the knotting operation is completed by the knotter 35, the winding operation is started again.

A large number of winding units 9 having the above-mentioned structure are arranged in the direction rectangular to the paper surface of the drawings, whereby one automatic winder is constructed.

Supposing that the face of the winding unit 9 on the side of the yarn passage Y is the front face, in the lower portion of the opposite back face of the winding unit, the cop supply conveyor belt 10 is arranged to travel along the unit, and in the lower portion of the front face of the unit, the empty bobbin delivery conveyor belt 11 is arranged along the unit. A tray delivery passage 36 is formed between the conveyor belts 10 and 11.

First and second guide plates 37 and 38 are secured to the unit stand between the cop supply conveyor 10 and the empty bobbin delivery conveyor 11 to form a passage for the trays 12, as shown in FIG. 5. More specifically, a delivery passage 41 having a width S is defined by a convex curved guide face 39 of the first guide plate 37 and a convex curved guide face 40 of the second guide plate 38, and the lower face of this passage is formed into a freely rotating disc 42. The tray 12 is placed on the disc 42 from the conveyor 10 and the tray is delivered along the passage 41 by rotation of the disc 42 in the direction of an arrow A.

Figure 6:
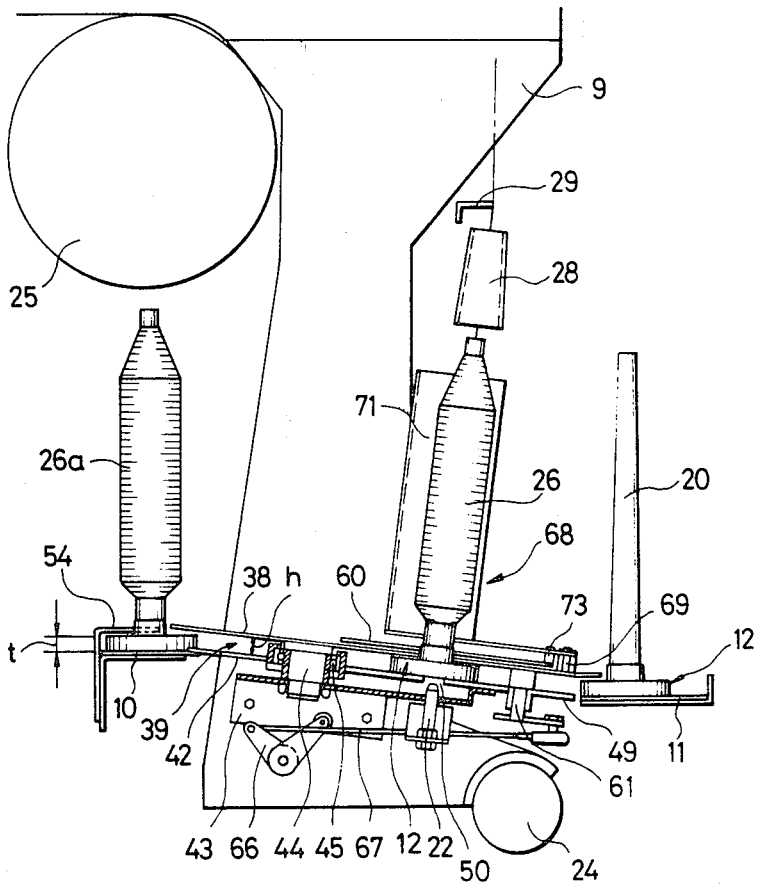
FIG. 6 is a sectional side view showing the tray-receiving portion of the winding unit.

Referring to FIG. 6, the disc 42 is pivoted on a shaft 44 on a bracket 43 secured to the side face of the unit 9. The shaft 44 is secured slightly inclinedly to the horizontal plane. Accordingly, the tray 12 on the disc 42 freely rotating through a bearing 45 is inclined to the vertical line by an angle corresponding to the inclination angle of the shaft 44. Namely, the central axis of the cop 26 on the tray 12 is inclined in the yarn-unwinding direction to facilitate the unwinding of the yarn. The curved guide faces 39 and 40 of the first and second guide plates 37 and 38 once terminate at the position P for taking out the yarn from the cop, and subsequent guide faces 47 and 48 defining an empty bobbin discharge passage 46 having a width S are formed on the guide plates 37 and 38, respectively.

A plane plate 49 secured to the bracket is fixed to the lower face of said discharge passage slantingly so that the plane plate 49 is located on the same plane as the top face of the disc 42. A clearance 50 is formed between the disc 42 and the plane plate 49 for taking out the yarn from the cop and this clearance is used as a passage for air jetted from the air jet nozzle 22 located below.

The disc 42 is arranged so that an annular band portion 53 defined by the periphery 51 of the disc 42 and an imaginary arc 52 separated by a certain distance l from the periphery 51 is pressed to the top face of the side portion of the conveyor belt 10 when the disc 42 rotates. Accordingly, the disc 42 is caused to rotate by the running force of the conveyor belt 10, and the conveyor belt 10 acts not only as means for delivering cops but also as the drive source for the disc 42.

A third guide plate 54 is secured at the position of each unit on the conveyor belt 10 to guide the tray 12 to the passage 41.

The guide plate 54 is secured so that the guide plate 54 is projected from the side portion of the conveyor toward the central portion of the conveyor while having a length at least larger than the thickness t of the base 13 of the tray 12 between both the surfaces of the conveyor 10 and the guide plate 54. A passage 58 is defined by a linear guide face 55 and subsequent curved guide face 56 of the guide plate 54 and a guide face 57 of the second guide plate 38 confronting the curved guide face 56. A guide face 59 of the third guide plate 54 acts as a guide for passing cops, which are delivered after a predetermined number of cops have been stored in the passage 41, through the position of the said winding unit. The width S of each of the passages 58, 41 and 46 is made slightly larger than the diameter d of the stand 14 of the tray 12 and the height h is made slightly larger than the thickness t of the base 13 of the tray 12.

A lever 60 for positioning and discharging the cop is pivoted on a stationary plate 49 so that the lever 60 is turned between a position 60*a* indicated by a two-dot chain line in FIG. 5 and a position 60 indicated by a solid line in FIG. 5 with a shaft 61 being as the center.

The shaft 61 of the lever 60 is inclined by the same angle as the inclination angle of the shaft 44 of the disc 42, and guide faces 62, 63 and 64 of the lever 60 turn on the plane parallel to the disc 42 and impinge against the stand 14 of the tray 12.

When the lever 60 is located at the position indicated by the solid line, a hook 65 of the lever 60 projects into the passage 41 and impinges against the stand 14 of the tray 12 to set the position of the cop. A curved guide face 63 of the hook 65 subsequent to the guide face 62 acts as a guide for pushing out the tray 12 at the winding position and discharging it along the passage 46, and the guide face 64 which is a part of the arc having the center at the shaft 61 acts as a guide for preventing delivery of the subsequent tray 12 having a new cop inserted thereon when the tray at the winding position is discharged.

The lever 60 is driven in the following manner. A rod (not shown) is actuated by a new cop supply instruction given from the winding unit to actuate a lever 66 shown in FIG. 6, and the shaft 61 is thus rotated through a connecting rod 67 to turn the lever 60.

A turnable balloon guide 68 is supported on a shaft 69 above the lever 60. This balloon guide 68 comprises an arm 70 and a curved plate 71 implanted and secured to the top end of the arm 70, and balloon guide 68 is urged in the clockwise direction in FIG. 5 by a spring 72 and is located at a position indicated by a solid line in FIGS. 5 and 6 during the winding operation in the unit, so that the balloon of the yarn taken out from the cop 26 is prevented from the subsequent cop standing by in the passage 41.

Positioning of the balloon guide 68 is accomplished by impingement of the side face of the arm 70 urged by the spring against a stopper 73 arranged on the end portion of the cop discharge lever 60.

Accordingly, when the lever 60 is turned to the position 60*a* indicated by the two-dot chain line in FIG. 6, the balloon guide 68 is turned in the clockwise direction in follow-up with the lever 60 with the shaft 69 being as the center. Namely, the balloon guide 68 is turned to the position where the arm 70 impinges against a stopper 73*a* located at the position by the two-dot chain line, and the curved plate 71 is retreated from the passage 41 and the tray 12 having a new cop inserted thereon is delivered to the yarn supply position P.

In the cop supply device having the above-mentioned structure, a full cop 26 from the spinning frame is inerted on the tray 12 delivered on the conveyor belt 10, and when the tray impinges against the guide 54, shown in FIG. 5, which is arranged in correspondence to the winding unit, the bottom face of the base of the tray 12 delivered along the passage 58 is shifted onto the disc 42 and by rotation of the disc 42 in the direction of arrow A, the tray 12 is delivered along the passage 41 and is stopped on engagement with the hook 65 in the bent portion of the passage 41.

When a predetermined number (3 in FIG. 5) of cop-carrying trays 12 delivered in the direction of an arrow 74 on the conveyor belt 10 are stored, the subsequent tray is passed through the passage 59 and prevented from impinging against the base 13 of the subsequent tray 12. Since the area of the contact face with the belt 10 is large, a large frictional force is exerted and the tray 12 at the inlet of the passage 41 is advanced along the guide face 59 and delivered to the next winding unit by the conveyor belt 10.

Accordingly, if the conveyor belt 10 is circulated, predetermined numbers of cops can be supplied to all the winding units, respectively.

The operation of taking out the yarn from the cop 26 located at the predetermined position shown in FIG. 4 and initiating the winding is performed according to the following procedures.

The air jet nozzle 22 is arranged below the tray 12 located at the predetermined position, and as described hereinbefore, air jetted from the nozzle 22 is jetted into the central hole of the bobbin 20 of the cop from the hole formed on the peg of the tray to blow up the yarn end Y1 hung down in the central hole 20 of the bobbin through the cylindrical balloon breaker 28 located above. The second suction arm 34 is brought close to the position 34*a* indicated by the two-dot chain line in FIG. 4 from the side of the winding unit and the yarn end blown up through the balloon breaker 28 is sucked and held by the suction arm 34. The suction arm 34 sucking the yarn end on the side of the cop is turned counterclockwise with the shaft 34*b* being as the center, and the first suction arm 33 sucking and holding the yarn end on the side of the package 27 is turned clockwise with the shaft 33*b* being as the center. Both the yarn ends are crossed each other and guided into the knotter 35 to effect knotting, and the ordinary winding operation is initiated.

When there is left no yarn on the bobbin at the yarn supply position, the detecting device arranged on the side of the winding unit is actuated to emit an empty bobbin discharge instruction, and the rod 67 for actuating the discharge lever 60, shown in FIG. 6, is actuated to turn the discharge lever 60 to the position 60*a* indicated by the two-dot chain line in FIG. 5, whereby, as shown in FIG. 4, the empty bobbin-carrying tray 12 is discharged onto the empty bobbin delivery conveyor belt 11. When the discharge lever 60 is returned to the original position, the subsequent tray 12*b* carrying a new cop thereon is moved along the passage 41 and set at the predetermined yarn supply position P.

In a cop coming from the spinning step, a tail yarn is ordinarily wound on one end of the bobbin, and a pick finding device for taking out the yarn end from the cop is disposed for each winder unit. The pick finding device and pick finding step are illustrated in FIGS. 7 and 8.

Figure 7:
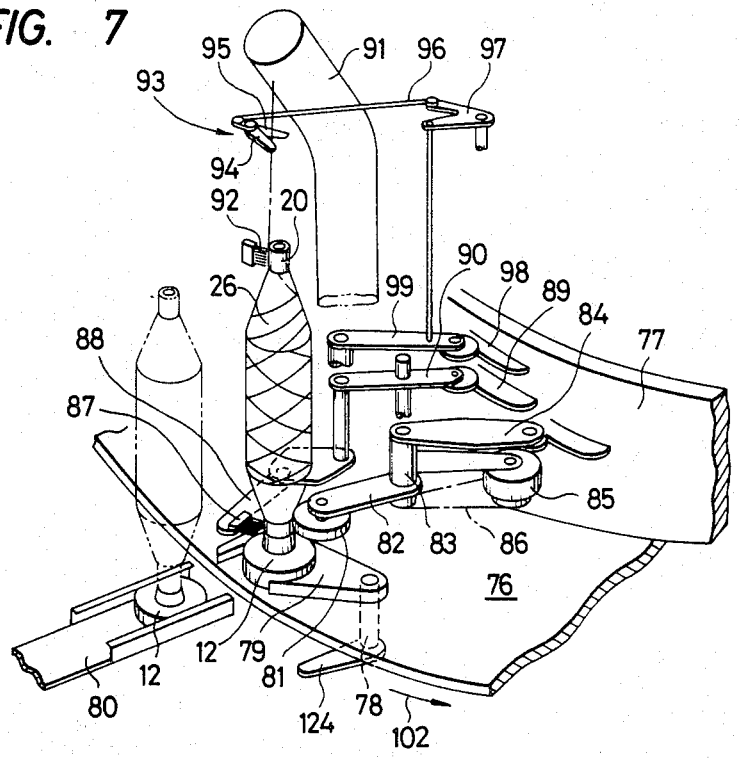
FIG. 7 is a schematic perspective view showing one unit of an example of the pick finding device.
Figure 8:
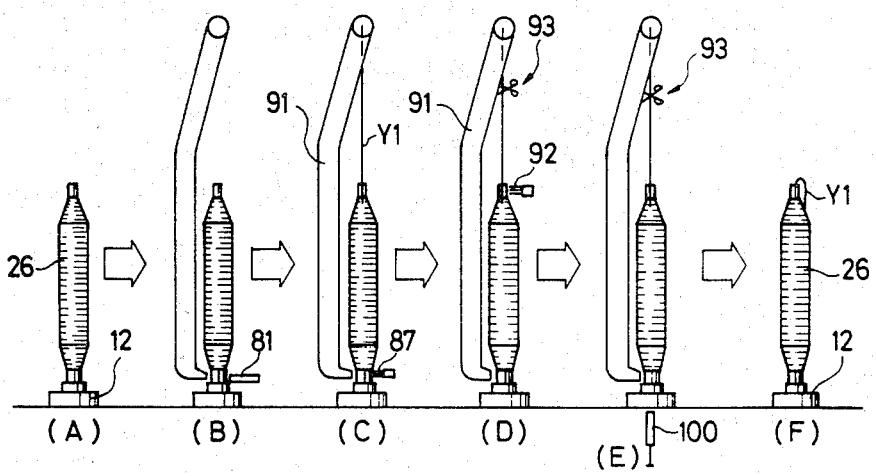
FIG. 8 is a diagram illustrating the pick finding process.

One unit of the pick finding device 75 is illustrated in FIG. 7, and each pick finding device is operated by a columnar frictional plate 77 arranged stationarily at the center of a rotary disc 76.

A tray fixing piece 79 is mounted on the rotary disc 76 so that the piece 79 can turn with a shaft 78 being as the center, and the tray fixing piece 79 receives the tray 12 delivered by a conveyor belt 80 and secures the tray 12.

A friction wheel 81 for rotating the cop 26 is pivoted on a turning lever 82 on the rotary disc 76, and the lever 82 is driven through a shaft 83 by a lever 84 turning with the shaft 83 being as the center. The friction wheel 81 is driven and rotated by a friction roller 85 rotated in contact with the frictional plate 77 through a chain or belt 86.

A brush 87 which is brought close to and separated from the tail yarn-wound portion to facilitate release of the bunch is secured to a turning lever 88, and the lever 88 is approached and separated by a cam 89 and a cam lever 90. A suction mouth 91 is disposed to suck the unwound yarn and a slit is formed on the mouth 91 in the longitudinal direction thereof to guide the sucked yarn above the cop. In order to prevent exceesive take-out of the yarn, a brush 92 is disposed so that the brush 92 is contacted with the bobbin 20. Approach and separation of the brush 92 are performed in the same manner as described with respect to the brush 87. A cutter 93 is arranged to cut the yarn taken out upward, and an ordinary cutting device in which cutting is accomplished by moving a movable blade 95 to a stationary blade 94 may be used as the cutter 93. The cutter 93 is attached on the axis of the cop so that when the yarn taken out is guided upward along the slit of the suction mouth, the yarn is intruded between the blades 94 and 95. The cutter is operated at a controlled timing by a cam lever 99 to be engaged with a cam 98 on the stationary column 77.

Furthermore, there may be adopted a modification in which a suction nozzle (100 in FIG. 8) for sucking the cut yarn end into the central hole of the bobbin is arranged below the rotary disc at the position confronting the cam operating the cutter and the yarn end is inserted in the hollow portion on the lower face of the tray through the hole formed in the rotary disc, and another modification in which suction nozzles are arranged at respective tray fixing positions of the rotary disc so that the suction force is exerted only when the cutter is operated.

This pick finding device 75 is arranged at the position shown in FIG. 1, that is, on the side portion of the winder 2. The rotary disc 76 is gradually rotated in the direction of an arrow 102 from a tray-receiving position 101 to perform the operation shown in FIG. 8, and when the rotary disc 76 makes substantially one rotation and arrives at a tray-discharging position 103, a tray discharging lever 124, shown in FIG. 7 becomes engaged with a stationary or moving member and the tray fixing piece 79 is turned and the tray is discharged on a conveyor belt 104.

More specifically, in FIG. 8, the operations of (A) receipt of the tray 12, (B) rotation of the cop by the friction wheel 81 and simultaneous suction of the yarn end by the suction mouth 91, (C) contact with the bunch releasing brush, (D) upward guide of the unwound yarn along the slit of the suction mouth 91 and prevention of excessive take-out of the yarn by the brush 92, (E) cutting of the yarn by the cutter 103 and simultaneous suction of the yarn end by the suction nozzle 100 and (F) discharge of the tray from the rotary disc are conducted in sequence.

In short, in the above-mentioned pick finding device, the pick finding operation is carried out while the cop is kept inserted on the tray 12, and the tray is only delivered substantially in the horizontal plane.

Referring to FIG. 1, the cop is supplied into the winding unit 9 in the state where the cop is inserted on the tray and the empty bobbin is discharged onto the conveyor belt 11 and delivered to the spinning frame again. The bobbin discharged onto the empty bobbin delivery conveyor 11 on the side of the winder 2 is not always an empty bobbin, but it sometimes happens that a cop still retaining thereon a yarn to be wound, such as a cop retaining a yarn because of an erroneous pick-finding or knotting operation, is discharged onto the empty bobbin delivery conveyor 11. Accordingly, a detecting device 105 for detecting a cop retaining the residual yarn thereon is disposed in the midway of the empty bobbin delivery belt conveyor. For example, a detecting device comprising a photoelectric tube is arranged. When the detecting device detects the remaining of the yarn layer on the bobbin, a shutter 106 is actuated to guide the tray being delivered, to a residual yarn-retaining bobbin pool 107. The cop once stored in the pool 107 is delivered to a yarn end-inserting position 108, and the yarn end is taken out manually or mechanically and is inserted into the central hole of the bobbin. Then, the cop is delivered to the cop supply conveyor belt 10 through a passage 109 and the above-mentioned operations are repeated.

A bobbin containing the residual yarn in such a small amount as cannot be detected by the residual yarn detecting device 105 is further delivered on a belt 110 and is detected by a slight residual yarn detecting device 111. In the same manner as described above, the bobbin is guided to a slight residual yarn-retaining bobbin pool 113 by the operation of a shutter 112. After the residual yarn has been removed, the empty bobbin is discharged onto the belt 110 and delivered to the spinning frame.

Figure 9A:
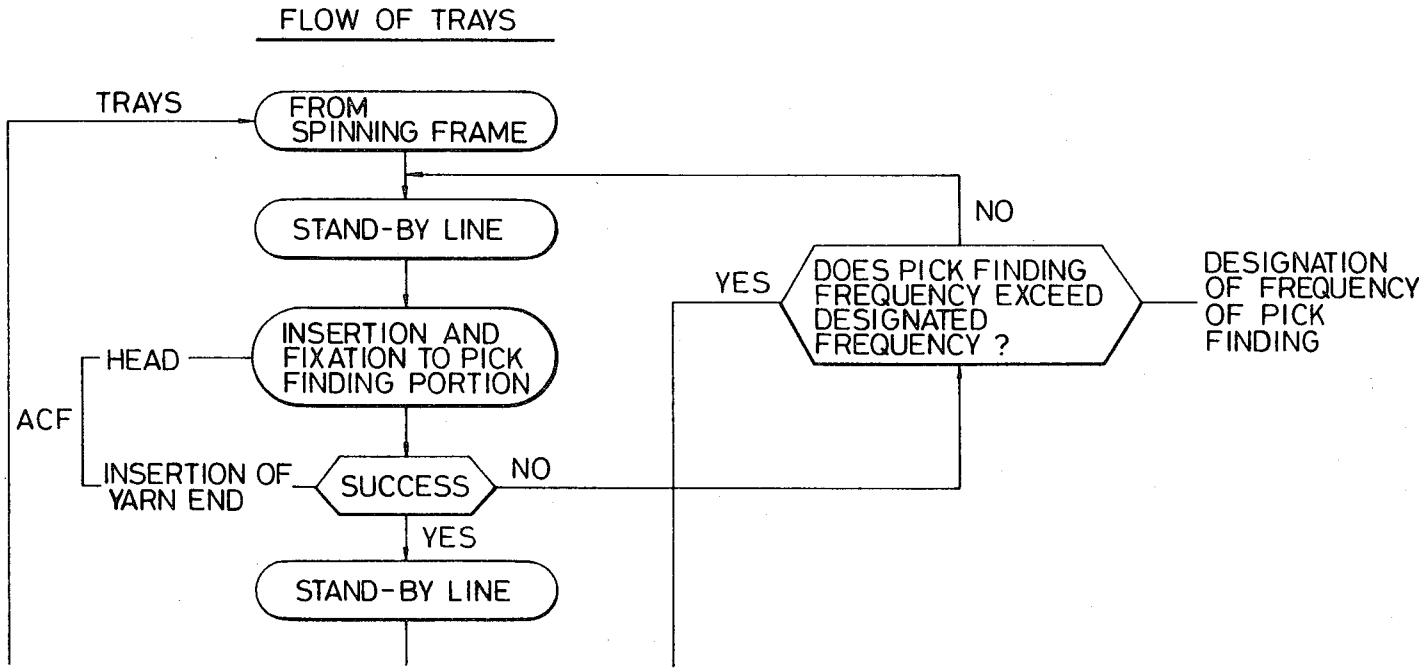
FIG. 9-*a* and FIG. 9-*b* are flows showing the flow of the trays.
Figure 9B:
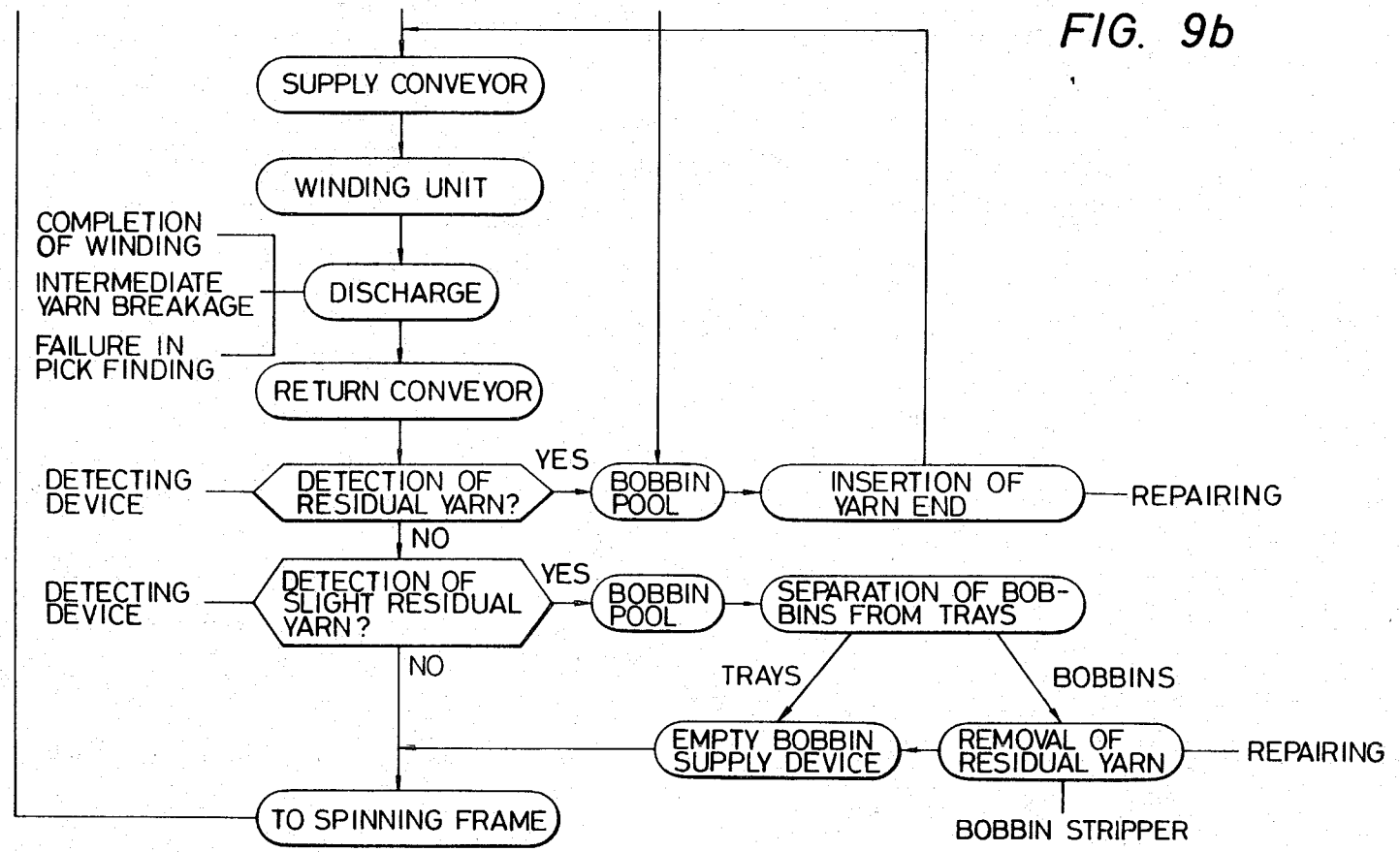

The above-mentioned main operations and auxiliary operations will now be summarized with reference to the flow chart of FIGS. 9-*a* and *b* and further to FIG. 1.

(a) Trays from the spinning frame stand by at a stand-by line 114 just before the pick finding device.

(b) The trays on the stand-by line are inserted, one tray for one unit, by induction of the pick finding units of the pick finding device 75.

(c) The yarn end is taken out from the cop and inserted into the central hole of the bobbin before the tray is discharged from the unit.

(d) Before discharge of the tray, success or failure in insertion of the yarn end is detected by the detecting device, and the route for the discharged tray is selected. Namely, when the inserting operation is not successful, the tray is transferred to a different route 115 and is returned to the inlet of the pick finding device. If the failure is repeated, the tray is transferred to another pool 107 for repairing. When the inserting operation is successful, the tray is fed to the next step.

(e) The tray on a stand-by line 116 just before the winder is supplied onto the cop supply conveyor belt 10 pursuant to the instruction of the winder. When there is no supply signal and the stand-by line 116 becomes full of trays, supply of new trays to the pick finding device is stopped.

(f) Each unit in the winder receives three trays, and the forefront unit 9*a* first becomes full.

(g) If the unit 9*e* just before the final unit becomes full, the cop supply conveyor 10 is stopped to keep the balance between the trays received by the units and the trays supplied by the conveyor 10.

(h) In each unit, exchange of trays is performed simultaneously with completion of the winding. When a new trays is located at the winding position, the yarn end in the central hole of the bobbin is blown up by the jetted air stream, and the yarn end blown up is caught by the suction arm on the side of the unit and is guided to the knotter.

(i) The tray discharged from the unit is delivered by the discharge conveyor 11, and the residual yarn-retaining bobbin is detected by the residual yarn-retaining bobbin detecting device 105 and discharged to the bobbin pool 107. After repairing, this bobbin is delivered to the cop supply conveyor 10.

(j) The slight residual yarn-retaining bobbin is detected and discharged by the slight residual yarn detecting device 111. After removal of repairing, the empty bobbin is delivered to the spinning frame 1.

(k) The tray having no residual yarn is directly delivered to the spinning frame 1.

In the above-mentioned manner, cops from the spinning step are supplied one by one to the winder, and the winding operation is carried out and empty bobbins are delivered to the spinning frame again.

As is apparent from the foregoing description, according to the present invention, a closed loop is formed between the spinning frame and the winder by tray delivery conveyor belts, and cops are independently inserted on trays, respectively, and the cops are delivered on the conveyor belts in the state where the cops are vertically inserted on the trays. Accordingly, if a tray-receiving passage is formed on each winding unit, the cops can be supplied into the winding units while they are inserted on the trays. Accordingly, the operations of once supplying cops into a magazine and inserting the cops onto pegs of the respective winding units, which are indispensable in the conventional system, can be omitted in the present invention, with the result that the cop supplying process can be shortened. Moreover, since a magagine, a chute and other auxiliary members need not be arranged on the front face of the winder, yarns travelling from the cops to packages can be observed with the naked eye, and occurrence of troubles during the winding operation can be found easily and rapidly, and repairing can be facilitated.

While the cops are delivered, an uncontrollable motion such as a falling movement utilizing the gravity is not performed, but the cops are delivered on the substantially horizontal plane. Accordingly, a falling shock or the like is not given to the cops, and the yarn layers of the cops are prevented from falling in contact with other members and other cops and occurrence of such troubles as contamination of the yarn layers and entanglement of yarns can be avoided.

Moreover, even if the number of winding units is increased or decreased, only by adjusting the length of cop supply conveyor and empty bobbin delivery conveyor, cops can be supplied effectively. Furthermore, since bobbins are separated and discharged from the winder one by one independently, selection of residual yarn-retaining bobbins and disposal of residual yarns can be facilitated.

What is claimed is:

1. A cop delivery system for automatically delivering cops from a spinning frame to a winder and empty bobbins from the winder to the spinning frame, the winder having an entrance and an exit opening, the system comprising:

a cop delivery conveyor connecting a spinning frame to a winder and forming a closed loop therebetween, said delivery conveyor including a discharge conveyor for moving empty bobbins to the spinning frame and a supply conveyor for moving cops to the winder;

a plurality of trays, each having a cop carried independently thereon, said trays being arranged on the delivery conveyor to convey cops;

pick finding means for performing a pick finding operation on each cop which is carried on a tray;

transfer means for moving a tray carrying a cop into and out of a winding position in the winder; and detection means for (a) monitoring bobbins after the winding operation to detect any residual yarn-retaining bobbin and (b) delivering each bobbin to either the supply conveyor or the discharge conveyor as a function of the monitoring operation.

2. A cop delivery system according to claim 1, wherein said detection means comprises:

a residual yarn detecting means for detecting residual yarn-retaining bobbins, the residual yarn-detecting means including a residual yarn-retaining bobbin pool member for supporting the detected residual yarn-retaining bobbins;

a shutter means for guiding detected residual yarn-retaining bobbins to the residual yarn-retaining bobbin pool member;

a yarn end-inserting means for placing the loose material end of the detected residual yarn-retaining bobbin into the bobbin cavity; and a passage for delivering the detected residual yarn-retaining bobbin resulting from the operation of the yarn end-inserting means to the supply conveyor for delivery to the winder.

3. A cop delivery system according to claim 2, wherein said detection means further includes a slight residual yarn detecting means for detecting bobbins wound with slight residual yarn and removing the slight residual yarn from said bobbins; and discharge means for discharging the resulting empty bobbin onto the discharge conveyor for delivery to the spinning frame.

4. A cop delivery system according to claim 1, wherein said pick finding means comprises:

a disc rotatable about a central axis;

a tray fixing piece having two ends, one end being pivotally mounted on the rotatable disc and the other end being configured to fix the position of a tray on the upper surface of the rotatable disc;

a rotatable friction wheel for rotating the cop;

a first brush which is brought close to the bottom portion of the cop to facilitate release of a free material end on the cop;

a first suction means for sucking the free material end on the cop so that said end is brought to a position above the top of the cop;

a cutting means for cutting the material sucked by the first suction means at a location on said material above the top of the cop;

a second suction means for sucking the cut end of the wound material resulting from operation of the cutting means through the top opening of the cop and into the central bobbin channel; and a columnar friction plate arranged stationarily at the center of the rotatable disc for rotating the friction wheel, bringing the first brush close to the cop and operating the cutting means.

5. A cop delivery system according to claim 1, wherein said transfer means includes a freely rotating disc rotatable about a central shaft, the shaft secured to the side face of the winding unit, the center of the rotating disc located closer to the winder entrance opening than to the winder exit opening, wherein the top of the axis of the rotating disc shaft is tilted away from the entrance opening and toward the exit opening.

6. A cop delivery system according to claim 5, further including a turnable balloon guide for maintaining one cop separate from another adjacent cop, the balloon guide comprising an arm and a curved plate, one end of the arm pivotally connected to a rotatable shaft, the axis of the rotatable shaft being parallel to the axis of the rotating disc shaft, the curved plate being perpendicular to the plane occupied by the transfer means rotating disc.

* * * * *